US011512880B2

(12) United States Patent
Morita et al.

(10) Patent No.: US 11,512,880 B2
(45) Date of Patent: Nov. 29, 2022

(54) REFRIGERATION CYCLE DEVICE

(71) Applicant: Mitsubishi Electric Corporation, Tokyo (JP)

(72) Inventors: Hisato Morita, Tokyo (JP); Kosuke Tanaka, Tokyo (JP); Kensaku Hatanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 95 days.

(21) Appl. No.: 16/328,455

(22) PCT Filed: Nov. 22, 2016

(86) PCT No.: PCT/JP2016/084596
§ 371 (c)(1),
(2) Date: Feb. 26, 2019

(87) PCT Pub. No.: WO2018/096580
PCT Pub. Date: May 31, 2018

(65) Prior Publication Data

US 2020/0049383 A1 Feb. 13, 2020

(51) Int. Cl.
*F25B 5/04* (2006.01)
*F25B 6/04* (2006.01)
(Continued)

(52) U.S. Cl.
CPC ..... *F25B 41/20* (2021.01); *F25B 7/00* (2013.01); *F25B 25/005* (2013.01); *F25B 40/02* (2013.01);
(Continued)

(58) Field of Classification Search
CPC ..... F25B 7/00; F25B 25/005; F25B 40/02; F25B 2400/05; F25B 2400/054; F25B 5/04; F25B 6/04
See application file for complete search history.

(56) References Cited

U.S. PATENT DOCUMENTS 1,329,559 A * 2/1920 Tesla ..... F16K 51/00 138/37
5,386,709 A * 2/1995 Aaron ..... F25B 5/02 62/199
(Continued)

FOREIGN PATENT DOCUMENTS

EP 1701112 A1 * 9/2006 ..... F25B 7/00
EP 1701112 A1 9/2006
(Continued)

OTHER PUBLICATIONS

Sensata Technologies—112cp series combined pressure temperature sensor datasheet Mar. 17, 2018 (Year: 2018).*
(Continued)

*Primary Examiner* — Christopher R Zerphey
*Assistant Examiner* — Bejeir Brooks
(74) *Attorney, Agent, or Firm* — Posz Law Group, PLC

(57) ABSTRACT

A refrigeration cycle apparatus includes a first refrigerant circuit including a first compressor, a first heat exchanger, a first refrigerant flow path of a second heat exchanger, a first expansion device, a third heat exchanger, and a second refrigerant flow path of a fourth heat exchanger, and a second refrigerant circuit including a second compressor, a fifth heat exchanger, a second expansion device, a third refrigerant flow path of the second heat exchanger, and a fourth refrigerant flow path of the fourth heat exchanger, a first refrigerant flows through, in order, the first compressor, the first heat exchanger, the first refrigerant flow path, the first expansion device, the third heat exchanger, and the second refrigerant flow path, the second refrigerant flows through, in order, the second compressor, the fifth heat exchanger, the second expansion device, the third refrigerant flow path, and the fourth refrigerant flow path.

18 Claims, 8 Drawing Sheets

(51) Int. Cl.

| | |
|---|---|
| ***F25B 40/06*** | (2006.01) |
| ***F25B 41/20*** | (2021.01) |
| ***F25B 7/00*** | (2006.01) |
| ***F25B 25/00*** | (2006.01) |
| ***F25B 40/02*** | (2006.01) |

(52) U.S. Cl.
CPC ..... *F25B 2309/002* (2013.01); *F25B 2400/06* (2013.01); *F25B 2600/2513* (2013.01); *F25B 2700/1933* (2013.01); *F25B 2700/2117* (2013.01)

(56) References Cited

U.S. PATENT DOCUMENTS

| | | | | | |
|---|---|---|---|---|---|
| 5,388,420 | A * | 2/1995 | Yoshida | F25B 7/00 | 62/160 |
| 5,784,893 | A * | 7/1998 | Furuhama | C09K 5/041 | 62/333 |
| 6,557,361 | B1 * | 5/2003 | Howard | F25B 7/00 | 62/175 |
| 2006/0032623 | A1 * | 2/2006 | Tsubone | F28D 20/00 | 165/202 |
| 2013/0219940 | A1 * | 8/2013 | Yamashita | F25B 25/005 | 62/160 |
| 2013/0227976 | A1 * | 9/2013 | Yamashita | F25B 9/006 | 62/126 |
| 2015/0285545 | A1 * | 10/2015 | Yamashita | F25B 13/00 | 62/196.1 |
| 2015/0300709 | A1 * | 10/2015 | Yamashita | F24F 3/065 | 62/190 |
| 2015/0330674 | A1 * | 11/2015 | Yamashita | F25B 7/00 | 62/160 |
| 2019/0309964 | A1 * | 10/2019 | Fujita | F24F 3/1423 | |

FOREIGN PATENT DOCUMENTS

| | | | | |
|---|---|---|---|---|
| EP | 2594867 | A2 * | 5/2013 | F24D 3/18 |
| EP | 2594867 | A2 | 5/2013 | |
| JP | 2005-114253 | A | 4/2005 | |
| JP | 2005-233559 | A | 9/2005 | |
| JP | 2007-232245 | A | 9/2007 | |
| JP | 2007232245 | A * | 9/2007 | |

OTHER PUBLICATIONS

Oxford Reference, Degrees of Superheat 2013 (Year: 2013).*
Sporlan, Pressure Temperature Chart Form 1B-714 (2014) (Year: 2014).*
Scott Johnson, Why Measure Three Types of Superheat, Contracting Business, Mar. 2013 (Year: 2013).*
International Search Report of the International Searching Authority dated Feb. 21, 2017 for the corresponding international application No. PCT/JP2016/084596 (and English translation).
Partial Supplementary European Search Report dated Dec. 13, 2019 issued in corresponding EP patent application No. 16922518.2.
Extended European Search Report dated Mar. 18, 2020 issued in corresponding EP patent application No. 16922518.2.
Office Action dated Feb. 25, 2022 issued in corresponding European patent application No. 16922518.2.

* cited by examiner

REFRIGERATION CYCLE DEVICE

TECHNICAL FIELD

The present invention relates to a refrigeration cycle apparatus including refrigerant circuits.

BACKGROUND ART

A refrigeration cycle apparatus that has been proposed includes a first refrigerant circuit including a compressor, a condenser, an expansion device, and an evaporator and a second refrigerant circuit including a subcooling heat exchanger (see, for example, Patent Literature 1). In the refrigeration cycle apparatus described in Patent Literature 1, the subcooling heat exchanger of the second refrigerant circuit causes subcooling of refrigerant that is condensed by the condenser of the first refrigerant circuit.

CITATION LIST

Patent Literature

Patent Literature 1: Japanese Unexamined Patent Application Publication No. 2007-232245

SUMMARY OF INVENTION

Technical Problem

A refrigeration cycle apparatus of the related art has a problem in that a contribution of the second refrigerant circuit to the first refrigerant circuit is limited to subcooling, and it is unlikely that the performance further improves.

The present invention has been accomplished to solve the above problem of the related art, and an object of the present invention is to provide a refrigeration cycle apparatus that enables a coefficient of performance (COP) to be improved.

Solution to Problem

A refrigeration cycle apparatus according to an embodiment of the present invention includes a first refrigerant circuit through which first refrigerant flows, the first refrigerant circuit including a first compressor, a first heat exchanger, a first refrigerant flow path of a second heat exchanger, a first expansion device, a third heat exchanger, and a second refrigerant flow path of a fourth heat exchanger; and a second refrigerant circuit through which second refrigerant flows, the second refrigerant circuit including a second compressor, a fifth heat exchanger, a second expansion device, a third refrigerant flow path of the second heat exchanger, and a fourth refrigerant flow path of the fourth heat exchanger, the first refrigerant flowing through the first refrigerant circuit in order of the first compressor, the first heat exchanger, the first refrigerant flow path, the first expansion device, the third heat exchanger, and the second refrigerant flow path, the second refrigerant flowing through the second refrigerant circuit in order of the second compressor, the fifth heat exchanger, the second expansion device, the third refrigerant flow path, and the fourth refrigerant flow path.

Advantageous Effects of Invention

The refrigeration cycle apparatus according to the embodiment of the present invention has the above structure and enables the COP to be improved.

DESCRIPTION OF EMBODIMENTS

Refrigeration cycle devices according to embodiments of the present invention will be described with reference to the drawings. The present invention is not limited to the form of each drawing described later. Modifications and alterations can be appropriately made without departing from the technical idea of the present invention.

Embodiment 1

Figure 1A:
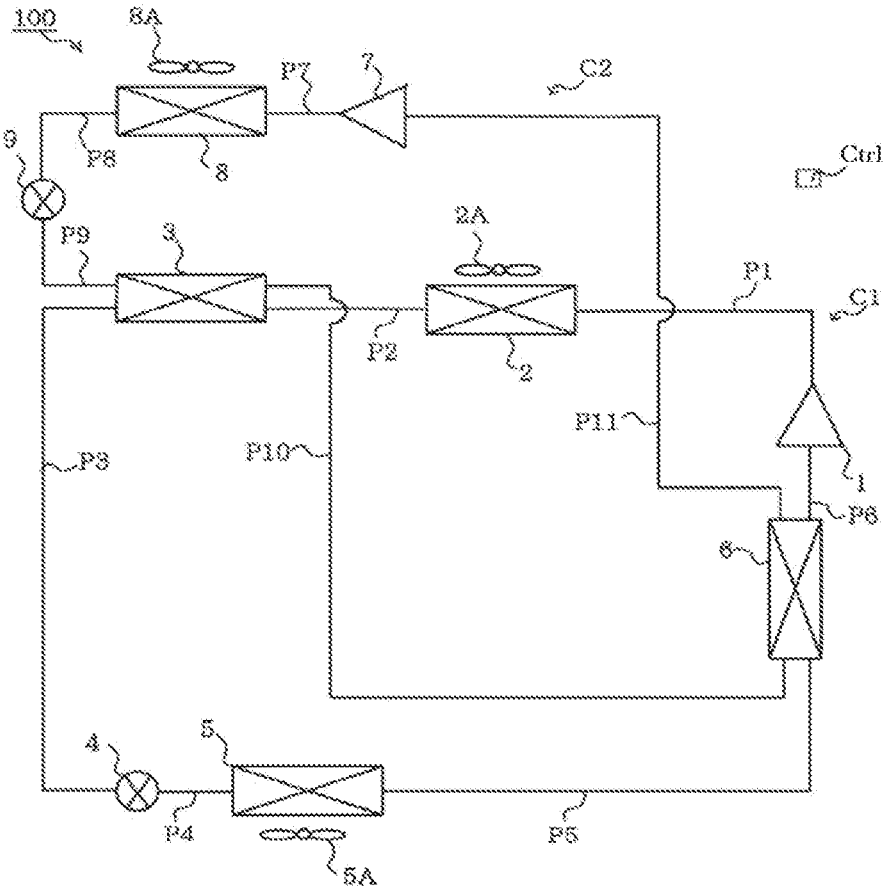
FIG. 1A illustrates the structure of a refrigeration cycle apparatus 100 according to Embodiment 1.

FIG. 1A illustrates the structure of a refrigeration cycle apparatus 100 according to Embodiment 1.

Figure 1B:
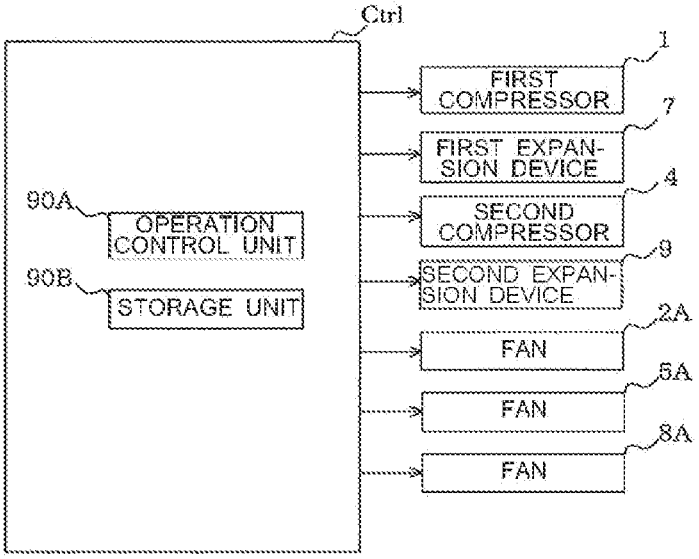
FIG. 1B is a functional block diagram of a controller Ctrl of the refrigeration cycle apparatus 100 according to Embodiment 1.

FIG. 1B is a functional block diagram of a controller Ctrl of the refrigeration cycle apparatus 100 according to Embodiment 1.

[Description of Structure]

The refrigeration cycle apparatus 100 includes a first refrigerant circuit C1 and a second refrigerant circuit C2. That is, the refrigeration cycle apparatus 100 has a cascade refrigeration cycle. The first refrigerant circuit C1 serves as a first refrigeration cycle (a low-temperature refrigeration cycle). The second refrigerant circuit C2 serves as a second refrigeration cycle (a high-temperature refrigeration cycle).

The cooling capacity of the second refrigerant circuit C2 is less than the cooling capacity of the first refrigerant circuit C1. The first refrigerant circuit C1 and the second refrigerant circuit C2 are separate from each other. First refrigerant that circulates through the first refrigerant circuit C1 and second refrigerant that circulates through the second refrigerant circuit C2 may be of the same kind or may differ in kind from each other.

Examples of the refrigeration cycle apparatus 100 include an air-conditioning device that cools an air-conditioned space and a refrigerator that cools the inside of the refrigerator. When the refrigeration cycle apparatus 100 is a refrigerator, the refrigeration cycle apparatus 100 may be used for cooling, freezing, or both. When the refrigeration cycle apparatus 100 is an air-conditioning device, the refrigeration cycle apparatus 100 may be provided with a single indoor unit or a plurality of indoor units. When two or more indoor units are provided, the capacities of the indoor units may be equal to each other or may differ from each other.

The refrigeration cycle apparatus 100 includes a controller Ctrl. The refrigeration cycle apparatus 100 also includes a fan 2A, a fan 5A, and a fan 8A. The refrigeration cycle apparatus 100 also includes refrigerant pipes P1 to P11 that connect components.

(First Refrigerant Circuit C1)

The first refrigerant circuit C1 includes a first compressor 1, a first heat exchanger 2, a first refrigerant flow path of a second heat exchanger 3, a first expansion device 4, a third heat exchanger 5, and a second refrigerant flow path of a fourth heat exchanger 6. The first refrigerant flows through the first refrigerant circuit C1. The first refrigerant flows through the first refrigerant circuit C1 in order of the first compressor 1, the first heat exchanger 2, the first refrigerant flow path of the second heat exchanger 3, the first expansion device 4, the third heat exchanger 5, and the second refrigerant flow path of the fourth heat exchanger 6. Specifically, the first refrigerant circuit C1 includes the refrigerant pipes P1 to P6. The refrigerant pipe P1 connects a refrigerant discharge port of the first compressor 1 and the first heat exchanger 2 to each other. The refrigerant pipe P2 connects the first heat exchanger 2 and the first refrigerant flow path of the second heat exchanger 3 to each other. The refrigerant pipe P3 connects the first refrigerant flow path of the second heat exchanger 3 and the first expansion device 4 to each other. The refrigerant pipe P4 connects the first expansion device 4 and the third heat exchanger 5 to each other. The refrigerant pipe P5 connects the third heat exchanger 5 and the second refrigerant flow path of the fourth heat exchanger 6 to each other. The refrigerant pipe P6 connects the second refrigerant flow path of the fourth heat exchanger 6 and a refrigerant suction port of the first compressor 1 to each other.

The first refrigerant circuit C1 has a first function of cooling an object to be cooled in the refrigeration cycle apparatus 100. The first function can be realized, for example, by cooling the third heat exchanger 5 that functions as an evaporator. The first function can also be realized, for example, by driving the fan 5A to supply air to the third heat exchanger 5 and cooling the air.

(Second Refrigerant Circuit C2)

The second refrigerant circuit C2 includes a second compressor 7, a fifth heat exchanger 8, a second expansion device 9, a third refrigerant flow path of the second heat exchanger 3, and a fourth refrigerant flow path of the fourth heat exchanger 6. The second refrigerant flows through the second refrigerant circuit C2. The second refrigerant flows through the second refrigerant circuit C2 in order of the second compressor 7, the fifth heat exchanger 8, the second expansion device 9, the third refrigerant flow path of the second heat exchanger 3, and the fourth refrigerant flow path of the fourth heat exchanger 6. Specifically, the second refrigerant circuit C2 includes the refrigerant pipes P7 to P11. The refrigerant pipe P7 connects a refrigerant discharge port of the second compressor 7 and the fifth heat exchanger 8 to each other. The refrigerant pipe P8 connects the fifth heat exchanger 8 and the second expansion device 9 to each other. The refrigerant pipe P9 connects the second expansion device 9 and the third refrigerant flow path of the second heat exchanger 3 to each other. The refrigerant pipe P10 connects the third refrigerant flow path of the second heat exchanger 3 and the fourth refrigerant flow path of the fourth heat exchanger 6 to each other. The refrigerant pipe P11 connects the fourth refrigerant flow path of the fourth heat exchanger 6 and a refrigerant suction port of the second compressor 7 to each other.

The second refrigerant circuit C2 has a second function of subcooling refrigerant flowing in the first refrigerant circuit C1 and a third function of cooling the first refrigerant that is to be sucked into the first compressor 1 of the first refrigerant circuit C1. The second function can be realized by cooling the first refrigerant that flows into the first refrigerant flow path of the second heat exchanger 3 by using the second refrigerant that flows into the third refrigerant flow path of the second heat exchanger 3. The third function can be realized by cooling the first refrigerant that flows into the second refrigerant flow path of the fourth heat exchanger by using the second refrigerant that flows into the fourth refrigerant flow path of the fourth heat exchanger.

(Compressors)

The first compressor 1 compresses the first refrigerant such that the first refrigerant has a high temperature and a high pressure. The second compressor 7 compresses the second refrigerant such that the second refrigerant has a high temperature and a high pressure. Examples of the first compressor 1 and the second compressor 7 can include an inverter control compressor.

(Heat Exchangers and Fans)

A side of the first heat exchanger 2 is connected to the first compressor 1 via the refrigerant pipe P1, and another side of the first heat exchanger 2 is connected to the second heat exchanger 3 via the refrigerant pipe P2. The fan 2A is installed to blow air to the first heat exchanger 2. The first heat exchanger 2 exchanges heat between air and the first refrigerant. The second heat exchanger 3 includes the first refrigerant flow path and the third refrigerant flow path. The second heat exchanger 3 has the second function described above. The second heat exchanger 3 can exchange heat between the first refrigerant that flows in the first refrigerant flow path and the second refrigerant that flows in the third refrigerant flow path. A side of the first refrigerant flow path of the second heat exchanger 3 is connected to the first heat exchanger 2 via the refrigerant pipe P2, and another side of the first refrigerant flow path of the second heat exchanger 3 is connected to the first expansion device 4 via the refrigerant pipe P3. A side of the third refrigerant flow path of the second heat exchanger 3 is connected to the second expansion device 9 via the refrigerant pipe P9, and another side of the third refrigerant flow path of the second heat exchanger 3 is connected to the fourth heat exchanger 6 via the refrigerant pipe P10.

A portion of the third heat exchanger 5 is connected to the first expansion device 4 via the refrigerant pipe P4, and another portion thereof is connected to the fourth heat exchanger 6 via the refrigerant pipe P5. The fan 5A is installed in the third heat exchanger 5. The third heat exchanger 5 exchanges heat between air and the first refrigerant. The third heat exchanger has the first function described above. When the refrigeration cycle apparatus 100 is an air-conditioning device, air cooled by the third heat exchanger 5 is supplied to the air-conditioned space.

The fourth heat exchanger 6 includes the second refrigerant flow path and the fourth refrigerant flow path. The fourth heat exchanger 6 has the third function described above. The fourth heat exchanger 6 can exchange heat between the first refrigerant that flows in the second refrigerant flow path and the second refrigerant that flows in the fourth refrigerant flow path. A portion of the second refrigerant flow path of the fourth heat exchanger 6 is connected to the third heat exchanger 5 via the refrigerant pipe P5, and another portion thereof is connected to the first compressor 1 via the refrigerant pipe P6. A portion of the fourth refrigerant flow path of the fourth heat exchanger 6 is connected to the second heat exchanger 3 via the refrigerant pipe P10, and another portion thereof is connected to the second compressor 7 via the refrigerant pipe P11.

A side of the fifth heat exchanger 8 is connected to the second compressor 7 via the refrigerant pipe P7, and another side of the fifth heat exchanger 8 is connected to the second expansion device 9 via the refrigerant pipe P8. The fan 8A is installed to blow air to the fifth heat exchanger 8. The fifth heat exchanger 8 exchanges heat between air and the second refrigerant.

The first heat exchanger 2 and the fifth heat exchanger 8 are not limited to the above example in which heat is exchanged between the refrigerant (the first refrigerant and the second refrigerant) and air. The first heat exchanger 2 and the fifth heat exchanger 8 may exchange heat between the refrigerant and a heat medium other than air. That is, heat medium circuits separate from the first refrigerant circuit C1 and the second refrigerant circuit C2 may be connected to the first heat exchanger 2 and the fifth heat exchanger 8. Examples of the heat medium include water, brine, and refrigerants. When the heat media are water and brine, pumps that move the water and the brine can be used instead of the fan 2A and the fan 8A that supply air. When the heat media are refrigerants, compressors that compress the refrigerants can be used instead of the fan 2A and the fan 8A that supply air.

(Expansion Devices)

The first expansion device 4 and the second expansion device 9 can each include a solenoid valve, the opening degree of which can be controlled. Capillaries can be used as the first expansion device 4 and the second expansion device 9.

(Controller Ctrl)

The controller Ctrl includes an operation control unit 90A and a storage unit 90B. The operation control unit 90A controls the rotation speed of the first compressor 1 and the rotation speed of the second compressor 7. When the first expansion device 4 and the second expansion device 9 are solenoid valves, the operation control unit 90A controls the opening degree of the first expansion device 4 and the opening degree of the second expansion device 9. The operation control unit 90A also controls the rotation speed of the fan 2A, the rotation speed of the fan 5A, and the rotation speed of the fan 8A. Various data sets are stored in the storage unit 90B.

The controller Ctrl includes functional units including dedicated hardware or a MPU (Micro Processing Unit) that runs programs that are stored in a memory. When the controller Ctrl is dedicated hardware, examples of the controller Ctrl include a single circuit, a composite circuit, an ASIC (application specific integrated circuit), a FPGA (field-programmable gate array), and a combination thereof. Each functional unit realized by the controller Ctrl may, alternatively, be realized by separate individual hardware. Alternatively, all of the functional units may be realized by a single piece of hardware. When the controller Ctrl is a MPU, each function performed by the controller Ctrl is realized by software, firmware, or a combination of software and firmware. The software and the firmware are written as programs and stored in the memory and executing the loaded programs. The MPU fulfills each function of the controller Ctrl by loading the programs stored in the memory. Examples of the memory include non-volatile or volatile semiconductor memories such as RAM, ROM, flash memory, EPROM and EEPROM.

Description of Operation According to Embodiment 1

Figure 1C:
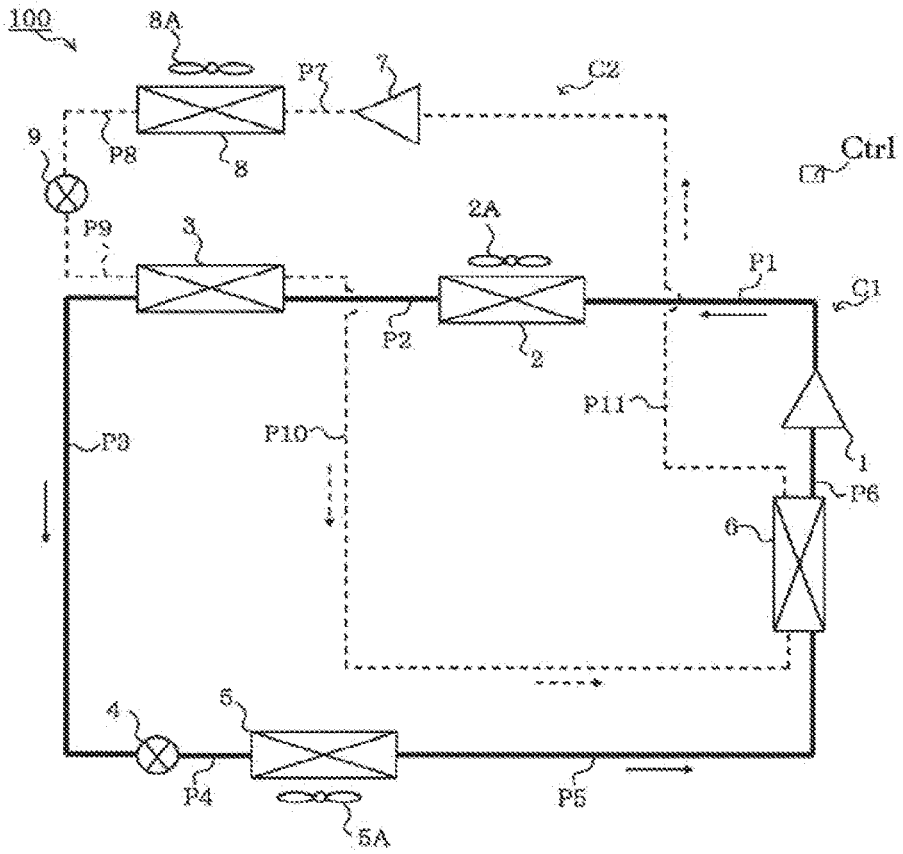
FIG. 1C illustrates flow of refrigerant in the refrigeration cycle apparatus 100 according to Embodiment 1.

FIG. 1C illustrates flow of refrigerant in the refrigeration cycle apparatus 100 according to Embodiment 1.

In FIG. 1C, flow of the first refrigerant is illustrated by a thick line, and flow of the second refrigerant is illustrated by a dotted line.

The first refrigerant in the first refrigerant circuit C1 flows into the first heat exchanger 2 after being discharged from the first compressor 1. The first refrigerant that flows into the first heat exchanger 2 transfers heat to air that is supplied from the fan 2A. The first refrigerant that flows out of the first heat exchanger 2 flows into the second heat exchanger 3. The first refrigerant is cooled at the second heat exchanger 3 by the second refrigerant. Consequently, subcooling occurs in the first refrigerant circuit C1 (the degree of subcooling increases). The first refrigerant that flows out of the second heat exchanger 3 is decompressed by the first expansion device 4, and the temperature and pressure thereof decrease. The first refrigerant that flows out of the first expansion device 4 flows into the third heat exchanger 5. The first refrigerant that flows into the third heat exchanger 5 removes heat from air that is supplied from the fan 5A to cool the air. The first refrigerant that flows out of the third heat exchanger 5 flows into the fourth heat exchanger 6. The first refrigerant is cooled by the second refrigerant at the fourth heat exchanger 6.

The second refrigerant in the second refrigerant circuit C2 flows into the fifth heat exchanger 8 after being discharged from the second compressor 7. The second refrigerant that flows into the fifth heat exchanger 8 transfers heat to air that is supplied from the fan 8A. The second refrigerant that flows out of the fifth heat exchanger 8 is decompressed by the second expansion device 9, and the temperature and pressure thereof decrease. The second refrigerant that flows out of the first expansion device 4 flows into the second heat exchanger 3 and subcools the first refrigerant. The refrigerant that flows out of the second heat exchanger 3 flows into the fourth heat exchanger 6. The second refrigerant cools the first refrigerant at the fourth heat exchanger 6.

Effects of Embodiment 1

Figure 1D:
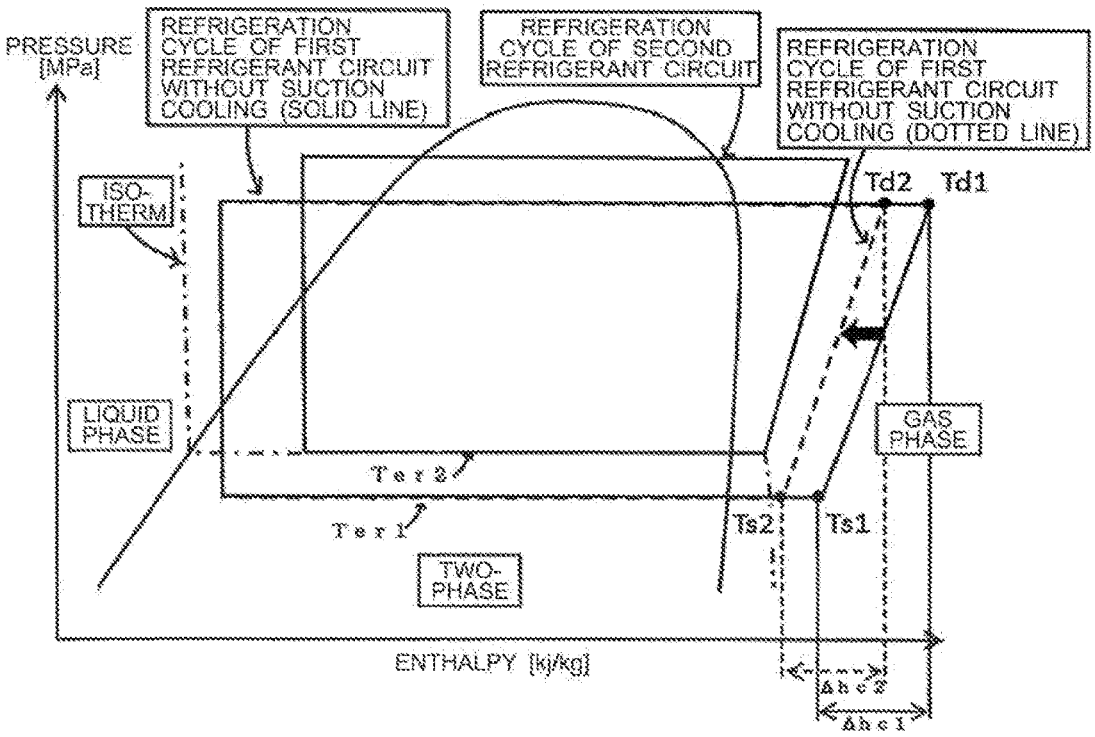
FIG. 1D illustrates p-h diagrams of the refrigeration cycle apparatus 100 according to Embodiment 1.

FIG. 1D illustrates p-h diagrams of the refrigeration cycle apparatus 100 according to Embodiment 1. In FIG. 1D, the first refrigeration cycle of the first refrigerant circuit C1 and the second refrigeration cycle of the second refrigerant circuit C2 are illustrated in the p-h diagrams. FIG. 1D illustrates, with a dashed line, the p-h diagram in the case where there is an effect of subcooling in the second heat exchanger 3 and there is suction cooling in the fourth heat exchanger 6. FIG. 1D illustrates, with a solid line, the p-h diagram in the case where there is subcooling in the second heat exchanger 3, while there is no suction cooling at the second heat exchanger 3.

Comparing the case where the fourth heat exchanger 6 is provided to the case where the fourth heat exchanger 6 is not provided, the amount of the refrigerant that circulates through the first refrigerant circuit C1 does not vary. However, comparing the case where the fourth heat exchanger 6 is provided to the case where the fourth heat exchanger 6 is not provided, an enthalpy difference Δhc in the first refrigerant circuit C1 decreases. This will be described.

The working of the fourth heat exchanger 6 decreases the temperature of the first refrigerant that is to be sucked into the first compressor 1. As illustrated in FIG. 1D, the temperature of the refrigerant that is to be sucked into the first compressor 1 decreases from Ts1 to Ts2. Consequently, the inclination of an isentropic line increases, and the enthalpy difference Δhc of the first compressor 1 decreases. As illustrated in FIG. 1D, the enthalpy difference Δhc decreases from an enthalpy difference of Δhc1 to an enthalpy difference of Δhc2.

Since the enthalpy difference Δhc decreases as above, the refrigeration cycle apparatus 100 enables an input (power supply) of the first compressor 1 to be reduced and enables a COP to be improved.

The working of the fourth heat exchanger 6 decreases the temperature of the refrigerant that is discharged from the first compressor 1. As illustrated in FIG. 1D, the temperature of the refrigerant that is discharged from the first compressor 1 decreases from Td1 to Td2. Consequently, the upper limit of the rotation speed of the first compressor 1 can be increased, and the operation range of the first compressor 1 can be increased. That is, the refrigeration cycle apparatus 100 can decrease the temperature of the refrigerant that is discharged from the first compressor 1 and can increase the operation range of the first compressor 1.

As the quality of the first refrigerant approaches 1, the efficiency of the first compressor 1 improves, and at this time, the first refrigerant becomes saturated gas, although this is not illustrated in FIG. 1D. For this reason, the refrigeration cycle apparatus 100 is preferably controlled such that the quality of the first refrigerant that is to be sucked into the first compressor 1 becomes 1. This further decreases the enthalpy difference Δhc and enables the COP of the refrigeration cycle apparatus 100 to be improved.

As an evaporating temperature Ter1 in the first refrigerant circuit C1 decreases, the density of the first refrigerant that is to be sucked into the first compressor 1 decreases. Therefore, the lower the evaporating temperature Ter1 in the first refrigerant circuit C1 is, the smaller the amount of the refrigerant that circulates through the first refrigerant circuit C1 becomes. In addition, the lower the evaporating temperature Ter1 in the first refrigerant circuit C1 is, the higher the compression ratio of the first refrigerant in the first compressor 1 is, and the higher a compressor input becomes. Therefore, as the evaporating temperature Ter1 in the first refrigerant circuit C1 decreases, the COP of the refrigeration cycle apparatus 100 decreases. In the refrigeration cycle apparatus 100, an evaporating temperature Ter2 in the second refrigerant circuit C2 is higher than the evaporating temperature Ter1 in the first refrigerant circuit C1. Consequently, the COP of an entire system can be improved in the case where the second refrigerant circuit C2 of the refrigeration cycle apparatus 100 causes subcooling in the first refrigerant circuit C1 and decreases the temperature of the refrigerant that is to be sucked into the first compressor 1 of the first refrigerant circuit.

A temperature range in which the first refrigerant is used may differ from a temperature range in which the second refrigerant is used. Different refrigerants that are suitable for the respective temperature ranges may be used. The first refrigerant and the second refrigerant may be Freon refrigerants such as R410A, R407C, and R404A, may be natural refrigerants such as CO2 and propane, or may be other refrigerants. A refrigerating machine oil of the first refrigerant circuit C1 may be the same as a refrigerating machine oil of the second refrigerant circuit C2. Different refrigerating machine oils may be used because the first refrigerant circuit C1 and the second refrigerant circuit C2 are separate from each other.

The refrigeration cycle apparatus 100 operates in a state where the evaporating temperature or the low pressure in the second refrigerant circuit C2 is higher than the evaporating temperature or the low pressure in the first refrigerant circuit C1.

Embodiment 2

Embodiment 2 will now be described with reference to the drawings. Components like those in Embodiment 1 described above are designated by like reference signs, and a detailed description thereof is omitted.

Figure 2A:
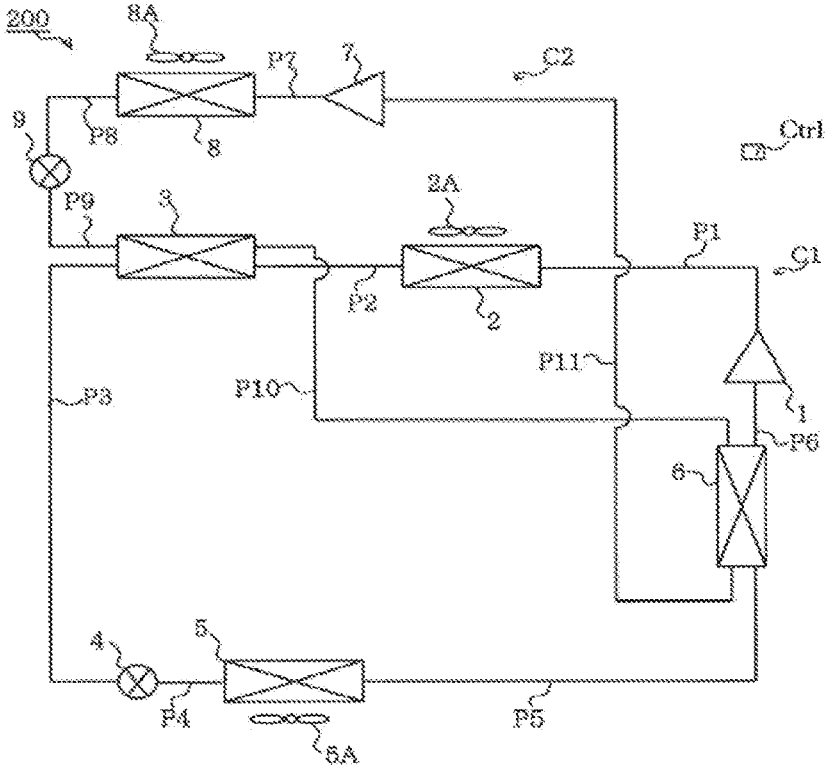
FIG. 2A illustrates the structure of a refrigeration cycle apparatus 200 according to Embodiment 2.

FIG. 2A illustrates the structure of a refrigeration cycle apparatus 200 according to Embodiment 2.

Figure 2B:
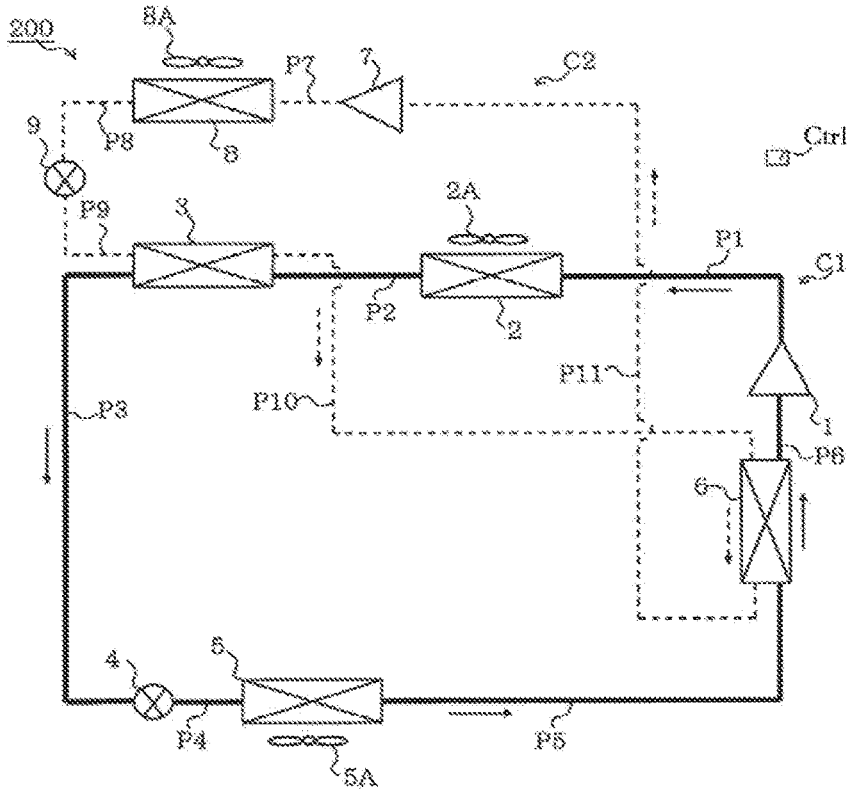
FIG. 2B illustrates flow of refrigerant in the refrigeration cycle apparatus 200 according to Embodiment 2.

FIG. 2B illustrates flow of refrigerant in the refrigeration cycle apparatus 200 according to Embodiment 2.

In FIG. 2B, flow of the first refrigerant is illustrated by a thick line, and flow of the second refrigerant is illustrated by a dotted line.

According to Embodiment 2, in the fourth heat exchanger 6, the first refrigerant flows in the second refrigerant flow path in a direction opposite to a direction in which the second refrigerant flows in the fourth refrigerant flow path. Specifically, there is an inverse relationship between connection of the refrigerant pipe P10 and the refrigerant pipe P11 to the fourth heat exchanger 6 according to Embodiment 2 and those according to Embodiment 1.

When the fourth heat exchanger 6 exchanges heat between the first refrigerant that flows through the first refrigerant circuit C1 and the second refrigerant that flows through the second refrigerant circuit C2 to remove heat of the first refrigerant into the second refrigerant, the evaporating temperature Ter1 is decreased to at most the evaporating temperature Ter2 of the flow in the second refrigerant circuit C2. The evaporating temperature Ter1 is higher than the evaporating temperature Ter2.

From the perspective of reliability of a compressor against, for example, damage, a typical refrigeration cycle apparatus is designed such that a degree of superheat is made at a suction port of the compressor. In the case where the direction in which the second refrigerant flows coincides with the direction in which the first refrigerant flows, a temperature range in which the first refrigerant can be cooled is given as the following expression (1).

[Math. 1]

$$Ter1>Ter2+SHs2 \quad (1)$$

The evaporating temperature Ter2 corresponds to the inlet temperature of the fourth heat exchanger 6 of the second refrigerant circuit C2. The degree of superheat SHs2 corresponds to a degree of superheat at the suction port of the second compressor 7.

In the case where the direction in which the second refrigerant flows is opposite to the direction in which the first refrigerant flows, the temperature range in which the first refrigerant can be cooled is given as the following expression (2).

[Math. 2]

$$Ter1>Ter2 \quad (2)$$

Effects of Embodiment 2

The refrigeration cycle apparatus 200 according to Embodiment 2 has the following effects in addition to the same effects as in the refrigeration cycle apparatus 100 according to Embodiment 1. According to Embodiment 2, the direction in which the first refrigerant flows in the second refrigerant flow path of the fourth heat exchanger 6 is opposite to the direction in which the second refrigerant flows in the fourth refrigerant flow path of the fourth heat exchanger 6. In the case where the directions are opposite to each other, the lower limit of the temperature range in which the first refrigerant can be cooled is less than that in the case where the directions coincide with each other. Consequently, the refrigeration cycle apparatus 200 according to Embodiment 2 enables the temperature of the refrigerant that is to be sucked into the first compressor 1 to be further decreased and enables the COP to be improved.

Embodiment 3

Embodiment 3 will now be described with reference to the drawings. Components like to those in Embodiment 1 and Embodiment 2 are designated by like reference signs, a detailed description is thereof omitted, and differences will be mainly described.

Figure 3A:
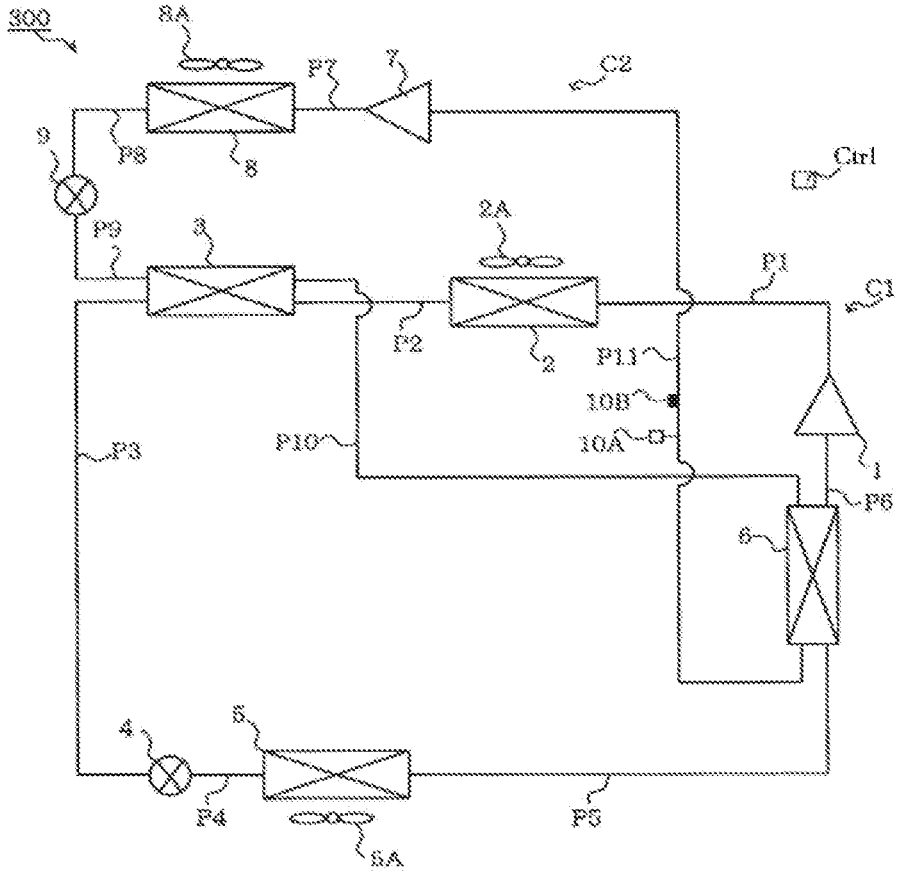
FIG. 3A illustrates the structure of a refrigeration cycle apparatus 300 according to Embodiment 3.

FIG. 3A illustrates the structure of a refrigeration cycle apparatus 300 according to Embodiment 3.

Figure 3B:
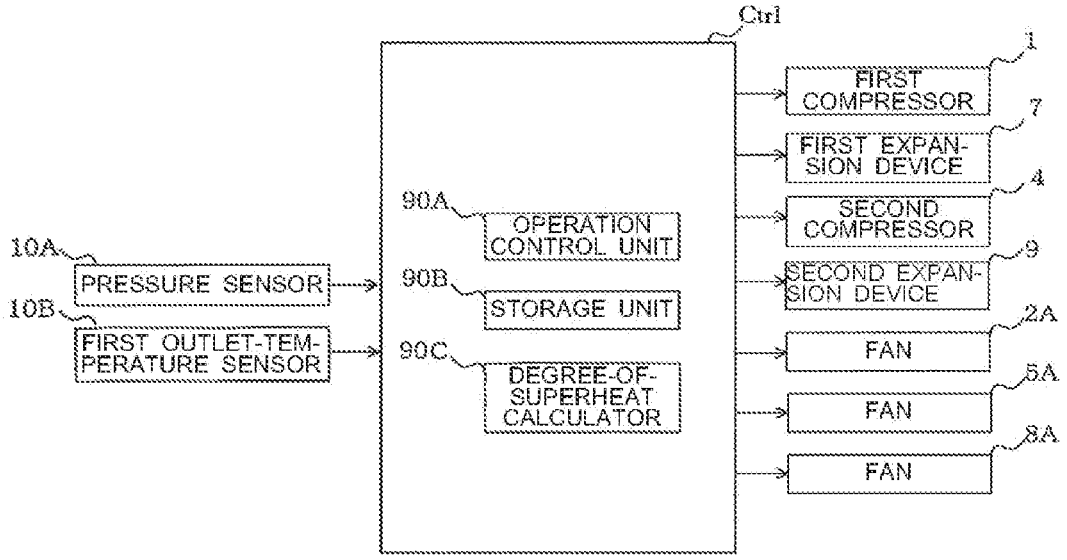
FIG. 3B is a functional block diagram of a controller Ctrl of the refrigeration cycle apparatus 300 according to Embodiment 3.

FIG. 3B is a functional block diagram of a controller Ctrl of the refrigeration cycle apparatus 300 according to Embodiment 3.

According to Embodiment 3, refrigerant circuits are provided with various kinds of sensors. The refrigeration cycle apparatus 300 controls the second expansion device 9 based on the degree of superheat obtained from each sensor. In an example described below, the refrigerant circuits according to Embodiment 3 are the same as those according to Embodiment 2 but may be the same as those according to Embodiment 1.

The refrigeration cycle apparatus 300 includes a pressure sensor 10A that detects the pressure of the second compressor 7 on the low-pressure side and a first outlet-temperature sensor 10B that detects the outlet temperature of the fourth refrigerant flow path of the fourth heat exchanger 6. The controller Ctrl controls the second refrigerant circuit C2 based on the pressure detected by the pressure sensor 10A and the temperature detected by the first outlet-temperature sensor 10B.

The controller Ctrl includes a degree-of-superheat calculator 90C that calculates the degree of superheat. The degree-of-superheat calculator 90C of the controller Ctrl calculates the degree of superheat in the second refrigerant circuit C2 based on a difference between a saturation temperature converted from the pressure detected by the pressure sensor 10A and the temperature detected by the first outlet-temperature sensor 10B. The degree of superheat calculated at this time is the degree of superheat at the suction port of the second compressor 7 of the second refrigerant circuit C2. The saturation temperature converted from the pressure detected by the pressure sensor 10A corresponds to the evaporating temperature.

The operation control unit 90A of the controller Ctrl controls the second expansion device 9 such that the degree of superheat becomes equal to or more than 0. The degree of superheat is the degree of superheat at the refrigerant suction port of the second compressor 7.

Effects of Embodiment 3

The refrigeration cycle apparatus 300 according to Embodiment 3 has the following effects in addition to the same effects as in the refrigeration cycle apparatus 100 according to Embodiment 1 and the refrigeration cycle apparatus 200 according to Embodiment 2. According to Embodiment 3, the second expansion device 9 is controlled such that the degree of superheat at the refrigerant suction port of the second compressor 7 becomes equal to or more than 0. That is, the second refrigerant is in the gas phase at the refrigerant suction port of the second compressor 7 and has a quality of 1 at the refrigerant suction port of the second compressor 7. Consequently, the second refrigerant containing liquid refrigerant flows into the second compressor 7, and the refrigeration cycle apparatus 300 inhibits the reliability from being reduced.

Since the second refrigerant becomes saturated gas having a quality of 1 at the refrigerant suction port of the second compressor 7, the refrigeration cycle apparatus 300 enables the efficiency of the compressor to be improved and enables the COP to be improved.

In the refrigeration cycle apparatus 300, two-phase gas-liquid flow of the second refrigerant occurs over the entire fourth refrigerant flow path of the fourth heat exchanger 6. Consequently, the refrigeration cycle apparatus 300 enables the heat-exchange efficiency of the fourth heat exchanger 6 to be improved.

According to Embodiment 3 described above, the opening degree of the second expansion device 9 is controlled based on the degree of superheat. This, however, is not a limitation. For example, the opening degree of the second expansion device 9 can be controlled based on the temperature of the refrigerant discharge port of the second compressor 7 instead of the degree of superheat at the refrigerant suction port of the second compressor 7. A discharge temperature sensor (not illustrated) is disposed between the refrigerant discharge port of the second compressor 7 and the fifth heat exchanger 8. Specifically, the discharge temperature sensor is provided at the refrigerant pipe P7. Based on the high pressure and low pressure in the second refrigerant circuit C2 and the above inclination in the p-h diagrams in FIG. 1D during a compression process of the second compressor 7, the controller Ctrl calculates the target value of the discharge temperature of the refrigerant discharged from the second compressor 7 such that the degree of superheat at the refrigerant suction port of the second compressor 7 is adjusted to a proper degree. The controller Ctrl controls the opening degree of the second expansion device 9 based on the target value of the discharge temperature of the refrigerant discharged from the second compressor 7. Also, with this structure, the same effects as in the refrigeration cycle apparatus 300 can be achieved.

Modification to Embodiment 3

Figure 3C:
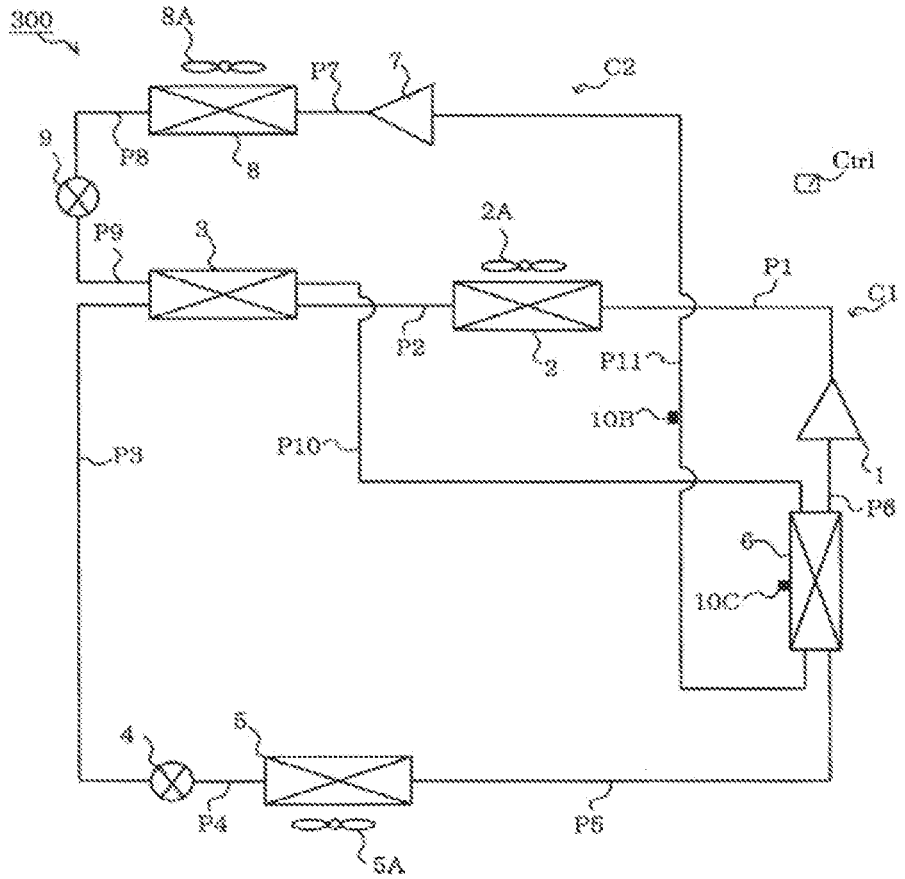
FIG. 3C illustrates the structure of a modification to Embodiment 3.

FIG. 3C illustrates the structure of a modification to Embodiment 3.

Figure 3D:
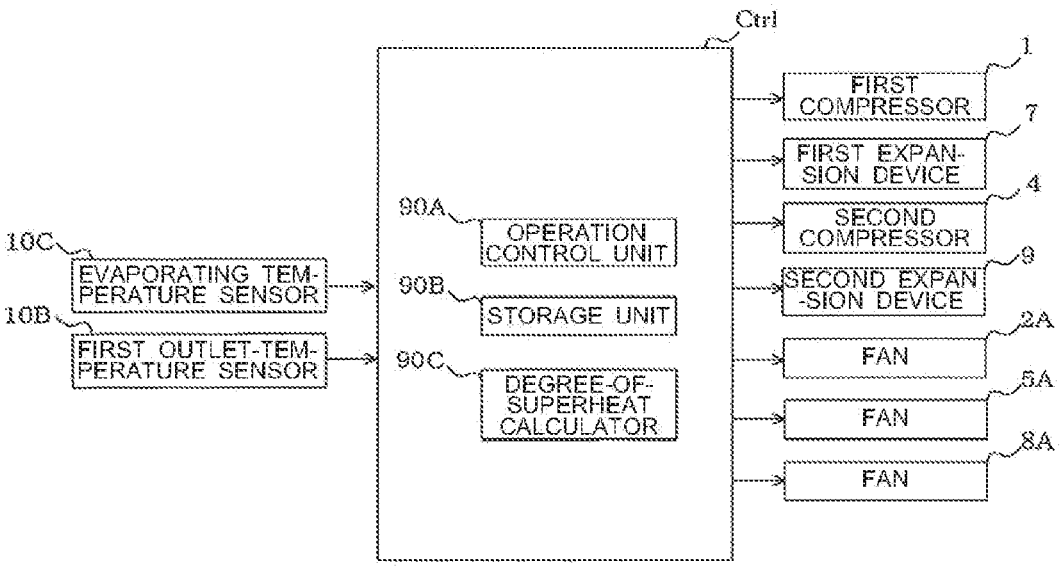
FIG. 3D is a functional block diagram of a controller Ctrl according to the FIG. 3C modification to Embodiment 3.

FIG. 3D is a functional block diagram of a controller Ctrl according to the modification to Embodiment 3 (FIG. 3C).

According to the modification to Embodiment 3 (FIG. 3C), the controller Ctrl calculates the degree of superheat by using an evaporating temperature sensor 10C instead of the pressure sensor 10A.

The refrigeration cycle apparatus 300 according to the modification includes the evaporating temperature sensor 10C that detects the evaporating temperature in the second refrigerant circuit C2 and the first outlet-temperature sensor 10B that detects the outlet temperature of the fourth refrigerant flow path of the fourth heat exchanger 6. The controller Ctrl controls the second refrigerant circuit C2 based on the temperature detected by the evaporating temperature sensor 10C and the temperature detected by the first outlet-temperature sensor 10B. The evaporating temperature sensor 10C is provided at the refrigerant pipe P5 and detects the outlet temperature of the third heat exchanger 5. The position of the evaporating temperature sensor 10C is not particularly limited provided that the evaporating temperature sensor 10C can detect the evaporating temperature and may be on the third refrigerant flow path of the second heat exchanger 3 or in the refrigerant pipe P10.

The degree-of-superheat calculator 90C of the controller Ctrl calculates the degree of superheat in the second refrigerant circuit C2 based on the temperature detected by the evaporating temperature sensor 10C and the temperature detected by the first outlet-temperature sensor 10B. The degree of superheat is the degree of superheat at the refrigerant suction port of the second compressor 7.

The refrigeration cycle apparatus 300 according to the modification achieves the same effects as in the refrigeration cycle apparatus 300 according to Embodiment 3.

Embodiment 4

Embodiment 4 will now be described with reference to the drawings. Components like to those in Embodiment 1 to Embodiment 3 are designated by like reference signs, and a detailed description thereof is omitted.

Figure 4A:
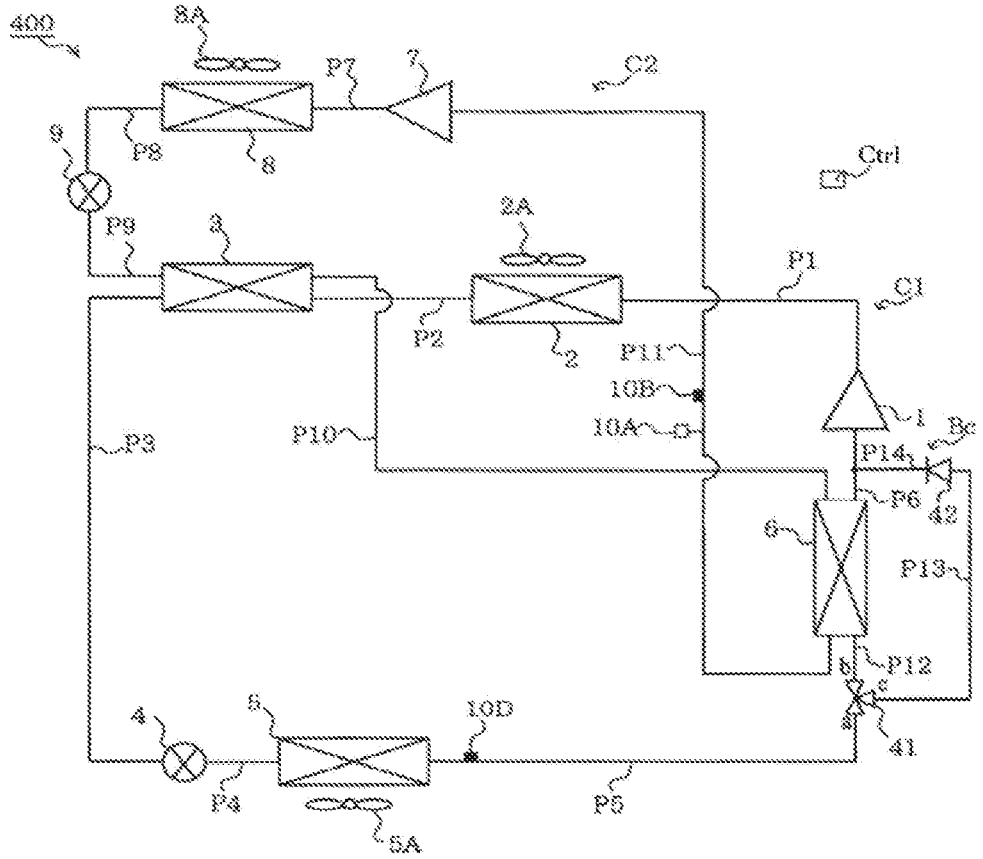
FIG. 4A illustrates the structure of a refrigeration cycle apparatus 400 according to Embodiment 4.

FIG. 4A illustrates the structure of a refrigeration cycle apparatus 400 according to Embodiment 4.

Figure 4B:
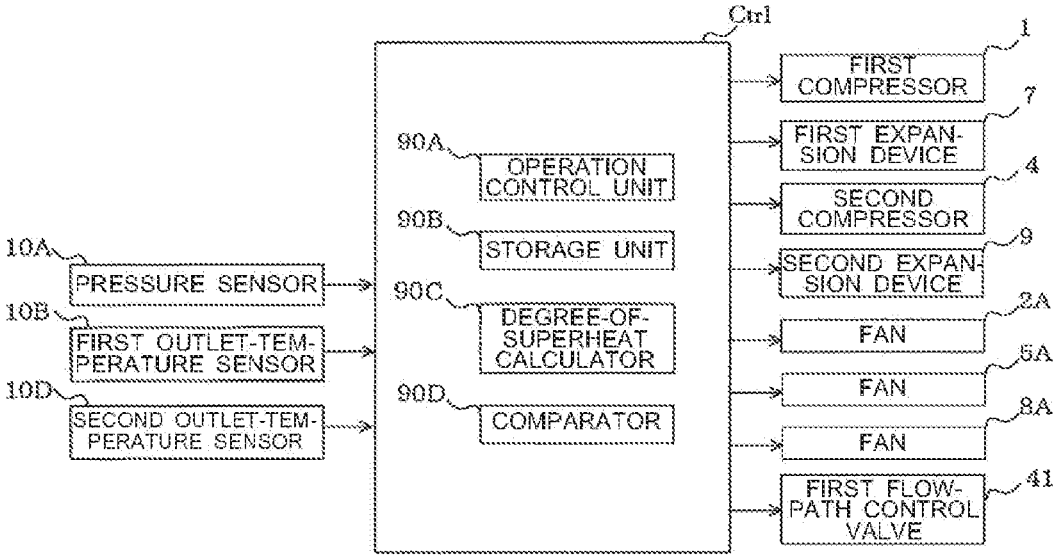
FIG. 4B is a functional block diagram of a controller Ctrl of the refrigeration cycle apparatus 400 according to Embodiment 4.

FIG. 4B is a functional block diagram of a controller Ctrl of the refrigeration cycle apparatus 400 according to Embodiment 4.

Figure 4C:
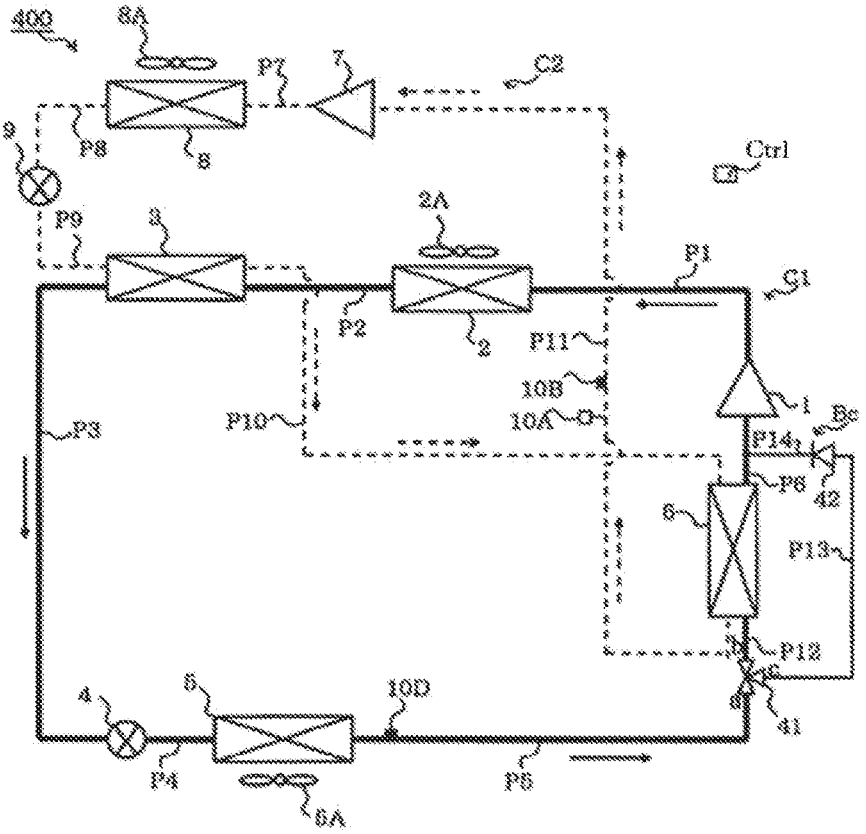
FIGS. 4C and 4D illustrate flow of refrigerant in the refrigeration cycle apparatus 400 according to Embodiment 4.
Figure 4D:
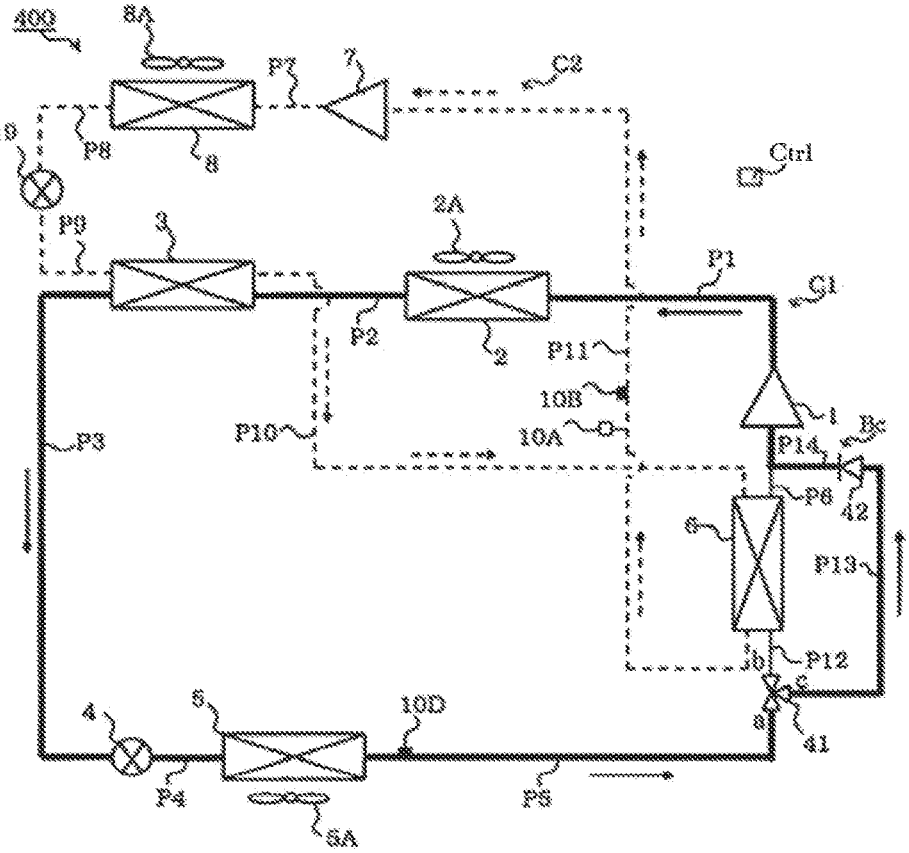

FIGS. 4C and 4D illustrate flow of refrigerant in the refrigeration cycle apparatus 400 according to Embodiment 4. FIG. 4C illustrates flow of the refrigerant in the case where a first valve flow path is not made and a second valve flow path is made. FIG. 4D illustrates flow of the refrigerant in the case where the second valve flow path is not made and the first valve flow path is made.

According to Embodiment 4, a second outlet-temperature sensor 10D is provided in addition to the various kinds of sensors described according to Embodiment 3. According to Embodiment 4, a bypass Bc is provided. Refrigerant circuits according to Embodiment 4 described below by way of example are based on the refrigerant circuits according to Embodiment 2 but may be based on the refrigerant circuits according to Embodiment 1.

The refrigeration cycle apparatus 400 includes the bypass Bc configured to bypass the fourth heat exchanger 6, and the bypass is provided at the first refrigerant circuit C1 and connected to a refrigerant pipe at the inlet side of the fourth heat exchanger 6 and a refrigerant pipe at the outlet side of the fourth heat exchanger 6. The bypass Bc includes a refrigerant pipe P13 and a refrigerant pipe P14.

The refrigeration cycle apparatus 400 includes a first flow-path control valve 41 to which the bypass Bc is connected, and the first flow-path control valve is provided at a flow path between the third heat exchanger 5 and the second refrigerant flow path of the fourth heat exchanger 6 in the first refrigerant circuit C1.

The first refrigerant circuit C1 of the refrigeration cycle apparatus 400 includes a second flow-path control valve 42 provided at the bypass Bc. The second flow-path control valve 42 prevents the first refrigerant that flows in a flow path (refrigerant pipe P6) between the second refrigerant flow path of the fourth heat exchanger 6 and the refrigerant suction port of the first compressor 1 from flowing into the bypass Bc. The second flow-path control valve 42 can include, for example, a check valve. Alternatively, the second flow-path control valve 42 can include a solenoid valve, opening and closing of which are controlled by the controller Ctrl.

The first flow-path control valve 41 includes a valve inlet a connected to the third heat exchanger 5, a first valve outlet b connected to the second refrigerant flow path of the fourth heat exchanger 6, and a second valve outlet c connected to the bypass Bc. The first flow-path control valve 41 is capable of selectively switching between the first valve flow path through which the first refrigerant flows from the valve inlet a to the first valve outlet b and the second valve flow path through which the first refrigerant flows from the valve inlet a to the second valve outlet c. The valve inlet a is connected to the refrigerant pipe P5. The first valve outlet b is connected to the refrigerant pipe P12. The second valve outlet c is connected to the refrigerant pipe P13.

The refrigeration cycle apparatus 400 includes the second outlet-temperature sensor that detects the temperature of a flow path (refrigerant pipe P5) between the third heat exchanger 5 and the first flow-path control valve 41. The controller Ctrl controls the second refrigerant circuit C2 based on the pressure detected by the pressure sensor 10A and the temperature detected by the first outlet-temperature sensor 10B. The controller Ctrl controls the first refrigerant circuit C1 based on the pressure detected by the pressure sensor 10A and the temperature detected by the second outlet-temperature sensor 10D.

The controller Ctrl includes a comparator 90D. The comparator 90D compares the saturation temperature converted from the pressure detected by the pressure sensor 10A and the temperature detected by the second outlet-temperature sensor 10D.

When the comparator 90D determines that the saturation temperature (evaporating temperature) related to the pressure detected by the pressure sensor 10A is higher than the temperature detected by the second outlet-temperature sensor 10D, the operation control unit 90A takes control in the following manner. The operation control unit 90A controls the first flow-path control valve 41 such that the first refrigerant flows in the second valve flow path to cause the first refrigerant to flow into the bypass Bc (see FIG. 4D). This avoids removing heat of the second refrigerant by the first refrigerant.

When the comparator 90D determines that the saturation temperature (evaporating temperature) related to the pressure detected by the pressure sensor 10A is equal to or lower than the temperature detected by the second outlet-temperature sensor 10D, the operation control unit 90A takes control in the following manner. The operation control unit 90A controls the first flow-path control valve 41 such that the first refrigerant flows in the first valve flow path to cause the first refrigerant to flow into the second refrigerant flow path of the fourth heat exchanger 6 (see FIG. 4C). This allows the second refrigerant to remove heat of the first refrigerant and decreases the temperature of the first refrigerant that is to be sucked into the first compressor 1.

Effects of Embodiment 4

For example, when the temperature of outdoor air is low, the temperature of the second refrigerant that flows in the fourth refrigerant flow path is higher than the temperature of the first refrigerant that flows in the second refrigerant flow path of the fourth heat exchanger 6 in some cases. In view of this, the refrigeration cycle apparatus 400 includes the bypass Bc and the other components, which avoids increasing the temperature of the first refrigerant that is to be sucked into the first compressor 1 in the fourth heat exchanger 6.

Embodiment 4 has a function of calculating the degree of superheat to control the second expansion device 9 as in Embodiment 3 although a description thereof is omitted.

Modification to Embodiment 4

Figure 4E:
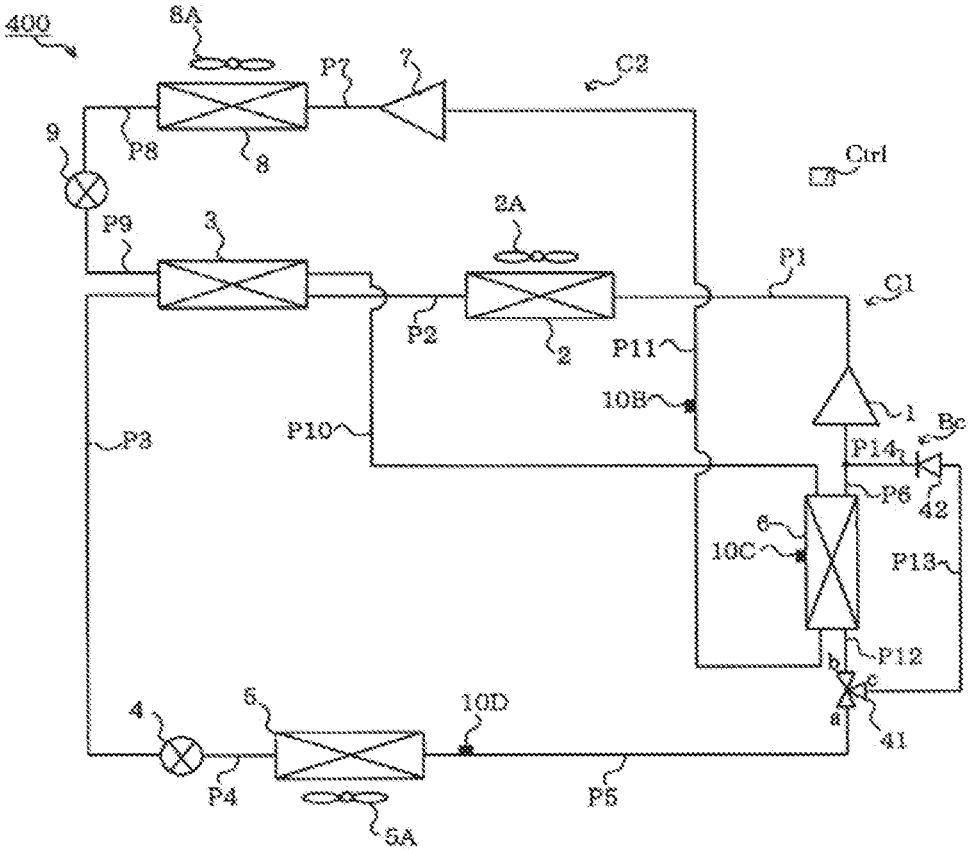
FIG. 4E illustrates the structure of a modification to Embodiment 4.

FIG. 4E illustrates the structure of a modification to Embodiment 4.

Figure 4F:
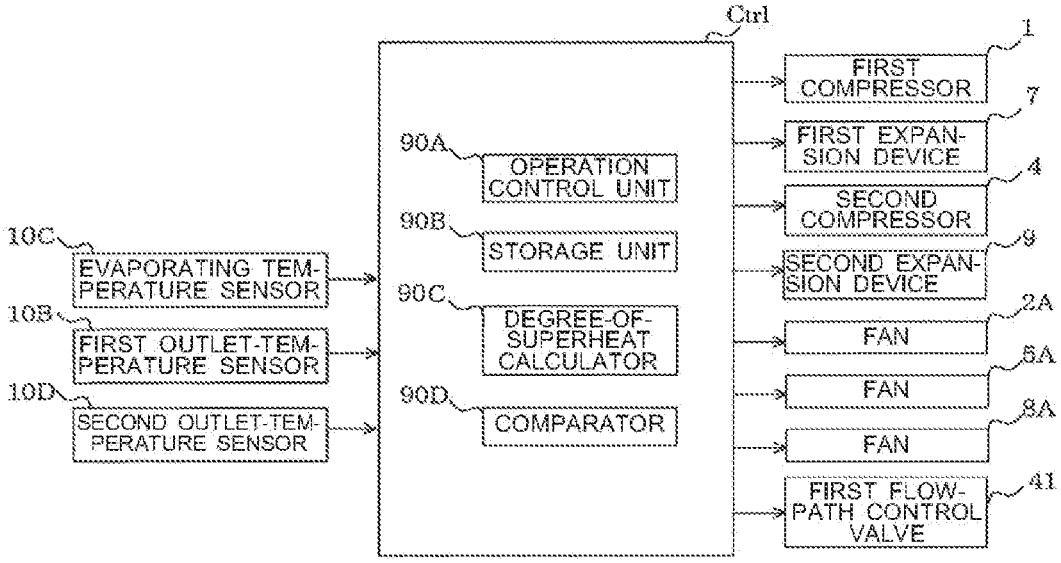
FIG. 4F is a functional block diagram of a controller Ctrl according to the modification to Embodiment 4.

FIG. 4F is a functional block diagram of a controller Ctrl according to the modification to Embodiment 4.

The modification to Embodiment 4 is based on the modification to Embodiment 3 and includes the evaporating temperature sensor 10C instead of the pressure sensor 10A. That is, according to the modification to Embodiment 4, the refrigeration cycle apparatus 400 includes the evaporating temperature sensor 10C that detects the evaporating temperature in the second refrigerant circuit. The controller Ctrl controls the second refrigerant circuit C2 based on the temperature detected by the evaporating temperature sensor 10C and the temperature detected by the first outlet-temperature sensor 10B. The controller Ctrl controls the first refrigerant circuit C1 based on the temperature detected by the evaporating temperature sensor 10C and the temperature detected by the second outlet-temperature sensor 10D.

When the temperature detected by the evaporating temperature sensor 10C is higher than the temperature detected by the second outlet-temperature sensor 10D, the controller Ctrl controls the first flow-path control valve 41 such that the first refrigerant flows in the second valve flow path to cause the first refrigerant to flow into the bypass. When the temperature detected by the evaporating temperature sensor 10C is equal to or lower than the temperature detected by the second outlet-temperature sensor 10D, the controller Ctrl controls the first flow-path control valve 41 such that the first refrigerant flows in the first valve flow path to cause the first refrigerant to flow into the second refrigerant flow path of the fourth heat exchanger 6.

The refrigeration cycle apparatus 400 according to the modification achieves the same effects as in the refrigeration cycle apparatus 400 according to Embodiment 4.

According to Embodiment 1 to Embodiment 4, the pressure sensor 10A can include a pressure sensor. The first outlet-temperature sensor 10B, the evaporating temperature sensor 10C, and the second outlet-temperature sensor 10D can each include, for example, a temperature sensor including a thermistor.

REFERENCE SIGNS LIST first compressor 2 first heat exchanger 2A fan 3 second heat exchanger 4 first expansion device 5 third heat exchanger 5A fan 6 fourth heat exchanger 7 second compressor 8 fifth heat exchanger 8A fan 9 second expansion device 10A pressure sensor 10B first outlet-temperature sensor 10C evaporating temperature sensor 10D second outlet-temperature sensor 41 first flow-path control valve 42 second flow-path control valve 90A operation control unit 90B storage unit 90C degree-of-superheat calculator 90D comparator 100 refrigeration cycle apparatus 200 refrigeration cycle apparatus 300 refrigeration cycle apparatus 400 refrigeration cycle apparatus Bc bypass C1 first refrigerant circuit C2 second refrigerant circuit Ctrl controller P1 refrigerant pipe P10 refrigerant pipe P11 refrigerant pipe P12 refrigerant pipe P13 refrigerant pipe P14 refrigerant pipe P2 refrigerant pipe P3 refrigerant pipe P4 refrigerant pipe P5 refrigerant pipe P6 refrigerant pipe P7 refrigerant pipe P8 refrigerant pipe P9 refrigerant pipe a valve inlet b first valve outlet c second valve outlet.

The invention claimed is:

1. A refrigeration cycle apparatus comprising:

a first refrigerant circuit including a first refrigerant, a first compressor, a first heat exchanger, a first refrigerant flow path of a second heat exchanger, a first expansion device, a third heat exchanger, and a first refrigerant flow path of a fourth heat exchanger; and a second refrigerant circuit including a second refrigerant, a second compressor, a fifth heat exchanger, a second expansion device, a second refrigerant flow path of the second heat exchanger, and a second refrigerant flow path of the fourth heat exchanger, the flow path of the first refrigerant is through the first refrigerant circuit in order of the first compressor, the first heat exchanger, the first refrigerant flow path of the second heat exchanger, the first expansion device, the third heat exchanger, and the first refrigerant flow path of the fourth heat exchanger, the third heat exchanger being connected directly to the first refrigerant flow path of the fourth heat exchanger, the flow path of the second refrigerant is through the second refrigerant circuit in order of the second compressor, the fifth heat exchanger, the second expansion device, the second refrigerant flow path of the second heat exchanger, and the second refrigerant flow path of the fourth heat exchanger, wherein the first refrigerant flow path of the second heat exchanger is located directly between a first inlet of the second heat exchanger and a first outlet of the second heat exchanger, the second refrigerant flow path of the second heat exchanger is located directly between a second inlet of the second heat exchanger and a second outlet of the second heat exchanger, the first refrigerant flow path of the fourth heat exchanger is located directly between a first inlet of the fourth heat exchanger and a first outlet of the fourth heat exchanger, the second refrigerant flow path of the fourth heat exchanger is located directly between a second inlet of the fourth heat exchanger and a second outlet of the fourth heat exchanger, the first refrigerant that flows into the first refrigerant flow path of the second heat exchanger is cooled with the second refrigerant that flows into the second refrigerant flow path of the second heat exchanger, the first refrigerant that flows from the third heat exchanger directly into the first refrigerant flow path of the fourth heat exchanger is cooled with the second refrigerant that flows into the second refrigerant flow path of the fourth heat exchanger, and the third heat exchanger is connected directly to the first expansion device, wherein the fourth heat exchanger is configured to pass the first refrigerant in the first refrigerant flow path of the fourth heat exchanger in a direction opposite to a direction in which the second refrigerant passes through the second refrigerant flow path of the fourth heat exchanger.

2. The refrigeration cycle apparatus of claim 1, further comprising:

a pressure sensor configured to detect a pressure on a low-pressure side of the second compressor;

a first outlet-temperature sensor configured to detect an outlet temperature of the second refrigerant flow path of the fourth heat exchanger; and a controller configured to control the second refrigerant circuit based on the pressure detected by the pressure sensor and the outlet temperature detected by the first outlet-temperature sensor.

3. The refrigeration cycle apparatus of claim 2, wherein the controller is configured to calculate a degree of superheat in the second refrigerant circuit based on a difference between a saturation temperature converted from the pressure detected by the pressure sensor and the outlet temperature detected by the first outlet-temperature sensor.

4. The refrigeration cycle apparatus of claim 1, further comprising:

an evaporating temperature sensor configured to detect an evaporating temperature in the second refrigerant circuit;

a first outlet-temperature sensor configured to detect an outlet temperature of the second refrigerant flow path of the fourth heat exchanger; and a controller configured to control the second refrigerant circuit based on the evaporating temperature detected by the evaporating temperature sensor and the outlet temperature detected by the first outlet-temperature sensor.

5. The refrigeration cycle apparatus of claim 4, wherein the controller is configured to calculate a degree of superheat in the second refrigerant circuit based on a difference between the evaporating temperature detected by the evaporating temperature sensor and the outlet temperature detected by the first outlet-temperature sensor.

6. The refrigeration cycle apparatus of claim 3, wherein the controller is configured to control the second expansion device such that the degree of superheat becomes equal to or more than 0.

7. The refrigeration cycle apparatus of claim 1, further comprising:

a bypass configured to bypass the fourth heat exchanger, the bypass being provided at the first refrigerant circuit and connected to a refrigerant pipe at an inlet side of the fourth heat exchanger and a refrigerant pipe at an outlet side of the fourth heat exchanger; and a first flow-path control valve provided at a flow path between the third heat exchanger and the first refrigerant flow path of the fourth heat exchanger in the first refrigerant circuit, the bypass being connected with the first flow-path control valve, wherein the first flow-path control valve includes a valve inlet connected to the third heat exchanger, a first valve outlet connected to the first refrigerant flow path of the fourth heat exchanger, and a second valve outlet connected to the bypass, and the first flow-path control valve is selectively switchable between a first valve flow path through which the first refrigerant flows from the valve inlet to the first valve outlet and a second valve flow path through which the first refrigerant flows from the valve inlet to the second valve outlet.

8. The refrigeration cycle apparatus of claim 7, wherein the first refrigerant circuit includes a second flow-path control valve provided at the bypass, and the second flow-path control valve is configured to prevent the first refrigerant flowing in a flow path between the first refrigerant flow path of the fourth heat exchanger and a refrigerant suction port of the first compressor from flowing into the bypass.

9. The refrigeration cycle apparatus of claim 1, further comprising:

a bypass configured to bypass the fourth heat exchanger, the bypass being provided at the first refrigerant circuit and connected to a refrigerant pipe at an inlet side of the fourth heat exchanger and a refrigerant pipe at an outlet side of the fourth heat exchanger;

a first flow-path control valve to which the bypass is connected, the first flow-path control valve being provided at a flow path between the third heat exchanger and the first refrigerant flow path of the fourth heat exchanger in the first refrigerant circuit;

a pressure sensor configured to detect a pressure of the second compressor on a low-pressure side;

a first outlet-temperature sensor configured to detect an outlet temperature of the second refrigerant flow path of the fourth heat exchanger;

a second outlet-temperature sensor configured to detect a temperature of a flow path between the third heat exchanger and the first flow-path control valve; and a controller configured to control the first refrigerant circuit and the second refrigerant circuit, wherein the first flow-path control valve includes a valve inlet connected to the third heat exchanger, a first valve outlet connected to the first refrigerant flow path of the fourth heat exchanger, and a second valve outlet connected to the bypass, the first flow-path control valve is selectively switchable between a first valve flow path through which the first refrigerant flows from the valve inlet to the first valve outlet and a second valve flow path through which the first refrigerant flows from the valve inlet to the second valve outlet, and the controller is configured to control the second refrigerant circuit based on the pressure detected by the pressure sensor and the outlet temperature detected by the first outlet-temperature sensor and control the first refrigerant circuit based on the pressure detected by the pressure sensor and the temperature detected by the second outlet-temperature sensor.

10. The refrigeration cycle apparatus of claim 9, wherein the controller is configured to control the first flow-path control valve such that the first refrigerant flows in the second valve flow path and flows into the bypass when a saturation temperature converted from the pressure detected by the pressure sensor is higher than the temperature detected by the second outlet-temperature sensor, and the controller is configured to control the first flow-path control valve such that the first refrigerant flows in the first valve flow path and flows into the first refrigerant flow path of the fourth heat exchanger when the saturation temperature converted from the pressure detected by the pressure sensor is equal to or less than the temperature detected by the second outlet-temperature sensor.

11. The refrigeration cycle apparatus of claim 9, wherein the controller is configured to calculate a degree of superheat in the second refrigerant circuit based on a difference between a saturation temperature converted from the pressure detected by the pressure sensor and the outlet temperature detected by the first outlet-temperature sensor.

12. The refrigeration cycle apparatus of claim 1, further comprising:

a bypass configured to bypass the fourth heat exchanger, the bypass being provided at the first refrigerant circuit and connected to a refrigerant pipe at an inlet side of the fourth heat exchanger and a refrigerant pipe at an outlet side of the fourth heat exchanger;

a first flow-path control valve provided at a flow path between the third heat exchanger and the first refrigerant flow path of the fourth heat exchanger in the first refrigerant circuit, the bypass being connected with the first flow-path control valve;

an evaporating temperature sensor configured to detect an evaporating temperature in the second refrigerant circuit;

a first outlet-temperature sensor configured to detect an outlet temperature of the second refrigerant flow path of the fourth heat exchanger;

a second outlet-temperature sensor configured to detect a temperature of a flow path between the third heat exchanger and the first flow-path control valve; and a controller configured to control the first refrigerant circuit and the second refrigerant circuit, wherein the first flow-path control valve includes a valve inlet connected to the third heat exchanger, a first valve outlet connected to the first refrigerant flow path of the fourth heat exchanger, and a second valve outlet connected to the bypass, the first flow-path control valve is selectively switchable between a first valve flow path through which the first refrigerant flows from the valve inlet to the first valve outlet and a second valve flow path through which the first refrigerant flows from the valve inlet to the second valve outlet, and the controller is configured to control the second refrigerant circuit based on the evaporating temperature detected by the evaporating temperature sensor and the outlet temperature detected by the first outlet-temperature sensor and control the first refrigerant circuit based on the evaporating temperature detected by the evaporating temperature sensor and the temperature detected by the second outlet-temperature sensor.

13. The refrigeration cycle apparatus of claim 12, wherein the controller is configured to control the first flow-path control valve such that the first refrigerant flows in the second valve flow path and flows into the bypass when the evaporating temperature detected by the evaporating temperature sensor is higher than the temperature detected by the second outlet-temperature sensor, and the controller is configured to control the first flow-path control valve such that the first refrigerant flows in the first valve flow path and flows into the first refrigerant flow path of the fourth heat exchanger when the evaporating temperature detected by the evaporating temperature sensor is equal to or less than the temperature detected by the second outlet-temperature sensor.

14. The refrigeration cycle apparatus of claim 12, wherein the controller is configured to calculate a degree of superheat in the second refrigerant circuit based on a difference between the evaporating temperature detected by the evaporating temperature sensor and the outlet temperature detected by the first outlet-temperature sensor.

15. The refrigeration cycle apparatus of claim 11, wherein the controller is configured to control the second expansion device such that the degree of superheat becomes equal to or more than 0.

16. The refrigeration cycle apparatus of claim 9, wherein the first refrigerant circuit includes a second flow-path control valve provided at the bypass, and the second flow-path control valve is configured to prevent the first refrigerant flowing in a flow path between the first refrigerant flow path of the fourth heat exchanger and a refrigerant suction port of the first compressor from flowing into the bypass.

17. The refrigeration cycle apparatus of claim 1, wherein a cooling capacity of the second refrigerant circuit is less than a cooling capacity of the first refrigerant circuit.

18. The refrigeration cycle apparatus of claim 1, wherein the refrigeration cycle apparatus is configured to operate in a state where an evaporating temperature or a low pressure in the second refrigerant circuit is higher than an evaporating temperature or a low pressure in the first refrigerant circuit.

* * * * *